United States Patent [19]

Ebata

[11] 3,962,756

[45] June 15, 1976

[54] CONTINUOUS COUPLING ELEMENT FOR SLIDE FASTENERS

[75] Inventor: Hiroyuki Ebata, Uozu, Japan

[73] Assignee: Yoshida Kogyo Kabushiki Kaisha, Japan

[22] Filed: Aug. 16, 1974

[21] Appl. No.: 498,103

[30] Foreign Application Priority Data

Sept. 21, 1973 Japan ..... 48-111094[U]

[52] U.S. Cl. ..... 24/205.16 C

[51] Int. Cl.[2] ..... A44B 19/12

[58] Field of Search ..... 24/205.1 C, 205.13 C, 24/205.16 C

[56] References Cited

UNITED STATES PATENTS

| | | | |
|---|---|---|---|
| 3,263,291 | 8/1966 | Taylor | 24/205.13 C |
| 3,694,868 | 10/1972 | Spindler | 24/205.13 C |
| 3,831,227 | 8/1974 | Beitter | 24/205.13 C |

FOREIGN PATENTS OR APPLICATIONS

| | | | |
|---|---|---|---|
| 713,257 | 7/1965 | Canada | 24/205.13 C |
| 2,018,346 | 4/1971 | Germany | 24/205.13 C |

*Primary Examiner*—Donald A. Griffin
*Attorney, Agent, or Firm*—Bucknam and Archer

[57] ABSTRACT

A continuous coupling element consists of an elongated filament of a synthetic resin or the like which is formed into a multiplicity of undulations including rows of first and second loops. A series of coupling heads are formed along one longitudinal side of the first loops, and the second loops are arranged along the other longitudinal side of the first loops. Each first loop further includes a pair of shanks which are arranged in substantially parallel spaced relationship in a plane perpendicular to the plane of the stringer tape. The general configuration of the first and second loops is such that they are held in contacting relationship at three dissimilar points for increased positional stability. The continuous coupling element can be fastened to the stringer tape by two rows of stitching, one passing over the shanks of the first loops and the other over the overlapping portions of the second loops.

5 Claims, 16 Drawing Figures

CONTINUOUS COUPLING ELEMENT FOR SLIDE FASTENERS

BACKGROUND OF THE INVENTION

This invention relates to coupling elements for slide fasteners, and in particular to the improved configuration of a continuous coupling element having a dual row of loops which can be fastened to a stringer tape as by stitching to provide a slide fastener half.

Continuous coupling elements for slide fasteners have been proposed and used in various configurations. Perhaps the most popular of such continuous coupling elements are those generally known as the coil and zigzag types. The continuous coupling elements of these well known types usually consist of elongated synthetic resin monofilaments which are shaped into a helical or zigzag configuration including a row of uniformly spaced apart coupling heads adapted for mating engagement with a similar row of heads of a complementary coupling element. A pair of legs or shanks extend rearwardly from each coupling head and are joined to arcuate or U-shaped bights bridging the adjacent shanks.

When the continuous coupling elements of these types are stitched onto stringer tapes as by a sewing machine, the elements must be retained in place on the tapes only by the threads extending longitudinally of the elements across their shanks. With the coupling elements fastened to the stringer tapes in this manner, there is no means for restraining them from lateral displacement. As a consequence, the prior art continuous coupling elements of the character described are prone to shift laterally out of their proper position when stitched to the stringer tapes.

In order to overcome this defect, there has been advanced another type of continuous coupling element having a multiplicity of undulations each consisting essentially of first and second loops. A row of coupling heads are formed along one longitudinal side of the first loops, and the second loops are arranged along the opposite longitudinal side of the first loops. These second loops constitute the support portion of this continuous coupling element, such that the same is stitched onto a stringer tape with the needle guided centrally through the successive second loops.

With this latter type of continuous coupling element, however, the row of stitches is located substantially the farthest transverse distance away from the coupling heads, so that the element cannot necessarily be stably anchored in position on the stringer tape. It is therefore highly likely that parts of the coupling elements should displace out of their correct relative positions in the act of coupling or uncoupling of the slide fastener stringers. In order to realize a high degree of coupling efficiency in slide fasteners, it is of absolute necessity that the individual undulations of the continuous coupling elements be faithfully maintained in their correct relative positions on the stringer tapes.

SUMMARY OF THE INVENTION

It is, therefore, an object of this invention to provide a novel and improved configuration in a continuous coupling element of the type having a dual row of loops.

Another object of the invention is to provide a continuous coupling element of the type described wherein the relative positional stability of the undulations is materially augmented.

Another object of the invention is to provide a continuous coupling element of the type described which can be securely affixed to a stringer tape as by two parallel rows of stitching.

The continuous coupling element according to this invention is made of an elongated filament of a synthetic resin of the like which is bent into a multiplicity of undulations consisting essentially of rows of first and second loops. The first loops include a series of coupling heads formed along one longitudinal side thereof, and the second loops are arranged along the other longitudinal side of the first loops. Each first loop further includes a pair of shanks which are arranged in substantially parallel spaced relationship in a plane perpendicular to the plane of a stringer tape on which this continuous coupling element is to be mounted. Thus the continuous coupling element according to the invention can be fastened to the stringer tape not only by a row of stitches extending across the second loops as in the prior art but also by another row of stitches extending across the first loops.

Further according to the novel concepts of this invention, the first and second loops should be arranged in contacting relationship in as many different points as possible to reinforce the relative positional stability of the undulations of the continuous coupling element. For this purpose, the pair of shanks of each first loop are compressed into contact with each other at their ends remote from the coupling head. The second loops are further arranged in overlapping relationship in contact with each other. Furthermore, the extensions from the shanks of the first loops, which extensions are arranged substantially annularly to define the respective second loops, include portions contacting each other. Thus the first and second loops are arranged in contacting relationship at three dissimilar points.

The features which are belived to be novel and characteristic of this invention are set forth with particularity in the appended claims. The invention itself, however, as well as the additional objects and advantages thereof, will be best understood from the following description of specific embodiments taken in conjunction with the accompanying drawings wherein like reference characters denote like parts throughout the several views.

DESCRIPTION OF THE PREFERRED EMBODIMENTS

Figure 1:
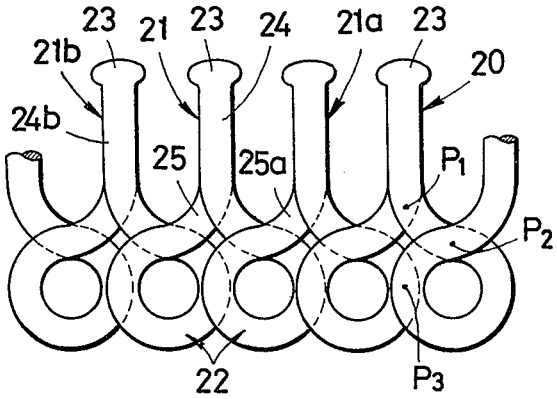
FIG. 1 is a plan view of the continuous coupling element according to this invention.
Figure 2:
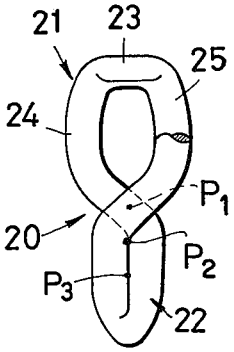
FIG. 2 is a right hand end view of the element shown in FIG. 1.

FIGS. 1 and 2 illustrate a preferred form of the continuous coupling element 20 for a slide fastener according to this invention. The illustrated continuous coupling element 20 is made of an elongated filament of a synthetic resin or the like which is formed into a multiplicity of undulations consisting essentially of a series of first loops 21 and another series of second loops 22. Formed along one longitudinal side of the first loops 21 is a series of uniformly spaced apart coupling heads 23 adapted for mating engagement with identical coupling heads, not shown, of a complementary continuous coupling element. The second loops 22 are formed along the other longitudinal side of the first loops 21.

According to the novel concepts of this invention, first and second legs or shanks 24 and 25 of one exemplary first loop 21, which are interconnected by the coupling head 23 on the said one side thereof, are arranged in substantially parallel spaced relationship to each other in a plane perpendicular to the plane of a stringer tape, not shown in FIGS. 1 and 2, to which the continuous coupling element 20 is to be fastened in the manner to be later described.

Also according to the novel concepts of the invention, those ends of the first and second shanks 24 and 25 which are remote from the coupling head 23 are compressed into contact with each other. The first and second shanks 24 and 25 further extend crosswise away from each other. The extension from the first shank 24 of the exemplary first loop 21 is again arranged crosswise, in a plane perpendicular to the plane of the stringer tape, in contact with a similar extension from the second shank 25*a* of the adjoining first loop 21*a* on the right hand side, as seen in FIG. 1, of the exemplary first loop 21. The annular second loop 22 is thus defined between the first loops 21 and 21*a* on the said other side thereof, the second loop being so disposed as to substantially parallel the plane of the stringer tape.

The extension from the second shank 25 of the exemplary first loop 21 is similarly arranged crosswise in contact with an extension from the first shank 24*b* of the left hand side first loop 21*b*, thereby also defining the annular second loop 22. Further according to this invention, the thus formed second loops 22 are arranged in overlapping relationship in contact with each other, as will be seen from the showing of FIG. 1.

It should be noted that the first and second loops 21 and 22 constituting the respective undulations of the continuous coupling element 20 are arranged in contacting relationship at three dissimilar points, namely, between the ends of the first and second shanks 24 and 25 of each first loop 21, between the crossing portions extending from the shanks 24 and 25 of the first loop 21, and between the overlapping portions of the adjoining second loops 22, as indicated by the reference characters P1, P2 and P3 respectively in FIG. 1.

Figure 3:
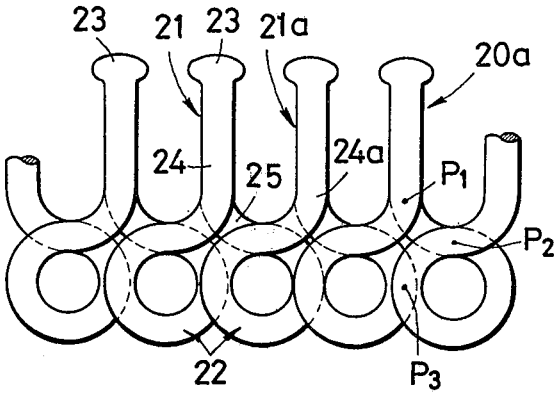
FIG. 3 is a plan view of another preferred embodiment of the invention.
Figure 4:
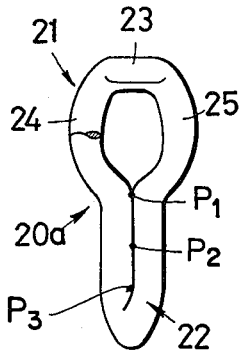
FIG. 4 is a right hand end view of the embodiment shown in FIG. 3.

FIGS. 3 and 4 illustrate a slight modification of the FIGS. 1 and 2 configuration, in which the extensions from the first and second shanks of the adjoining first loops are not arranged crosswise in a plane perpendicular to the plane of the stringer tape as in the preceding embodiment. Instead, each annular second loop 22 of this modified continuous coupling element 20*a* is defined by forming a single turn of the extension from the second shank 25 of each first loop 21 in a plane substantially parallel to the plane of the stringer tape and by joining the extension of the first shank 24*a* of the right hand side first loops 21*a*. Other details of construction are substantially the same as those set forth above in connection with FIGS. 1 and 2.

Figure 5:
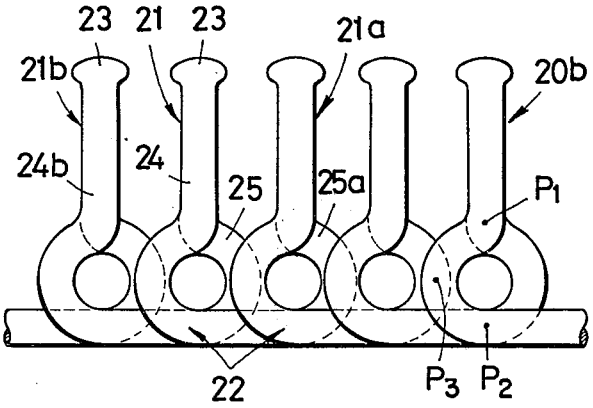
FIG. 5 is a plan view of a further preferred embodiment of the invention.
Figure 6:
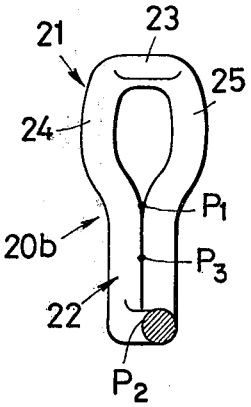
FIG. 6 is a right hand end view of the embodiment shown in FIG. 5.

FIGS. 5 and 6 illustrate another modified example, in which the extension from the first shank 24 of each first loop 21 of the continuous coupling element 20*b* is curved arcuately in a plane parallel to the plane of the stringer tape, thereby defining the left hand half, as seen in FIG. 5, of each second loop 22. The second shank 25 of each first loop is likewise curved arcuately so as to define the right hand half of each second loop 22. These extensions from the first and second shanks 24 and 25 of the first loop 21 are further joined to the similar extensions from the second shank 25*a* of the right hand side first loop 21*a* and the first shank 24*b* of the left hand side first loop 21*b*.

Figure 7:
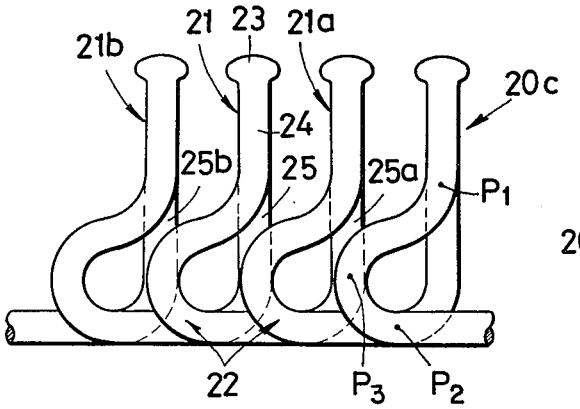
FIG. 7 is a plan view of a yet further preferred embodiment of the invention.
Figure 8:
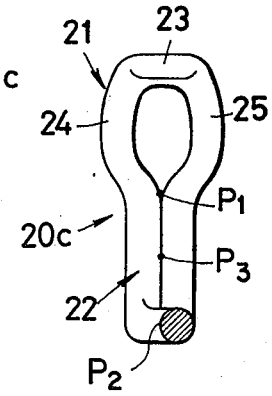
FIG. 8 is a right hand end view of the embodiment shown in FIG. 7.

In a further modified example illustrated in FIGS. 7 and 8, the extension from the second shank 25 of each first loop 21 of the continuous coupling element 20*c* is arranged along the plane of the first loop 21. The extension from the first shank 24 of the first loop 21, on the other hand, is curved in the shape of a U and is arranged in overlapping relationship to the extension from the second shank 25*b* of the left hand side first loop 21*b*. The U-shaped extension from the first shank 24 of the first loop 21 is further joined to the extension from the second shank 25*a* of the right hand side first loop 21*a* thereby defining the second loop 22 between the adjoining first loops 21 and 21*b*.

It may be noted that in all the modified examples set forth in the foregoing with reference to FIGS. 3 to 8, the first and second loops 21 and 22 constituting the respective undulations of the continuous coupling elements 20*a*, 20*b* or 20*c* are arranged in contacting relationship at three unlike points as specified by the respective reference characters P1, P2 and P3 in the drawings.

Figure 9:
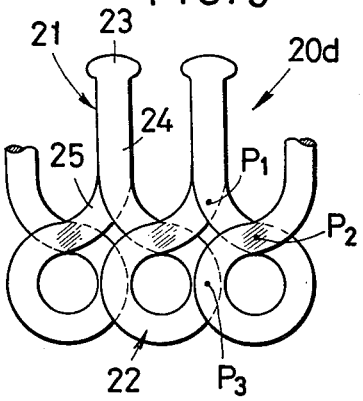
FIG. 9 is a plan view showing one possible modification of the continuous coupling element according to the invention, in which parts of the filament are integrally welded together.
Figure 10:
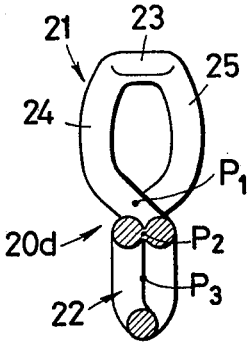
FIG. 10 is a cross sectional view of the modified element shown in FIG. 9.

If desired, the crossing portions P2 of the extensions from the first and second shanks of the adjoining first loops of the continuous coupling elements 20 and 20*a* may be welded or otherwise integrally united together, as in the continuous coupling element 20*d* depicted in FIGS. 9 and 10.

Figure 11:
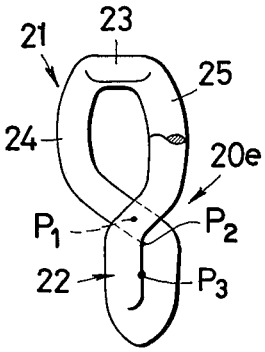
FIG. 11 is a view similar to FIG. 2 except that the element is made cross-sectionally asymmetric.
Figure 12:
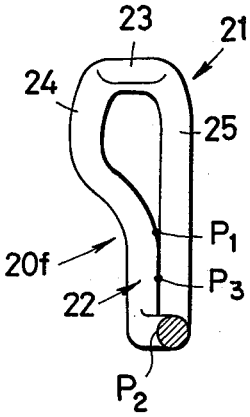
FIG. 12 is a view similar to FIG. 6 or 8 except that the element is also made cross-sectionally asymmetric.

When seen in an end view or cross-sectionally, the various continuous coupling elements disclosed hereinbefore are all symmetric, as will be seen from the showings of FIGS. 2, 4, 6 and 8. However if desired, all these continuous coupling elements can be made cross-sectionally asymmetric as represented by the continuous coupling elements 20*e* and 20*f* shown in FIGS. 11 and 12 respectively, so that the lower sides of the elements, that is, those sides to be held in direct contact with the stringer tape, may offer a plane parallel to the plane of the stringer tape.

Figure 13:
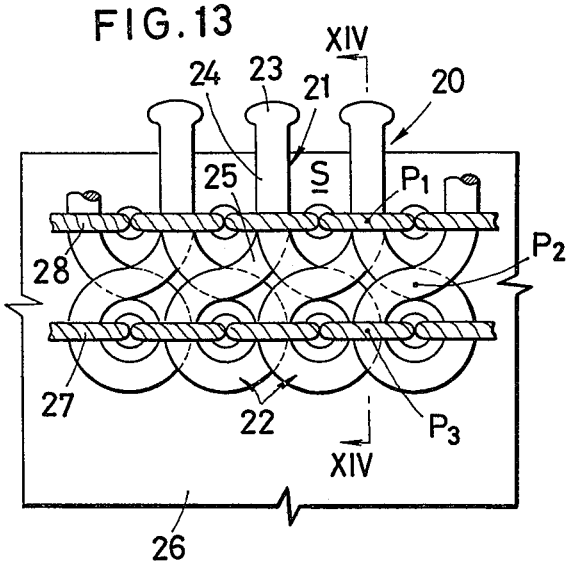
FIG. 13 is a top plan view showing a mode of attachment of the continuous coupling element according to the invention to a stringer tape.
Figure 14:
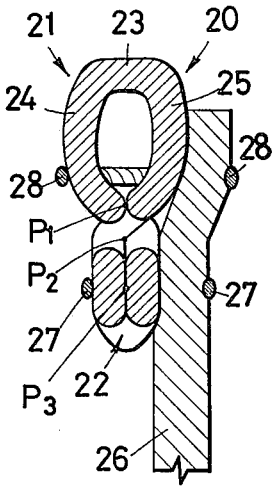
FIG. 14 is a cross sectional view taken along the plane of line XIV—XIV in FIG. 13.

FIGS. 13 and 14 illustrate a mode of attachment of the continuous coupling element 20 to the stringer tape 26, it being understood that the other continuous coupling elements 20*a* to 20*f* disclosed herein can be attached in an identical manner. As will be seen from these drawings, the continuous coupling element 20 is fastened to one surface of the stringer tape 26 along one longitudinal edge thereof by two parallel spaced rows of stitching 27 and 28. The first row of stitching 27 is formed by passing the sewing machine needle centrally through the successive second loops 22, as has been known heretofore. Since the shanks 24 and 25 of the respective first loops 21 are arranged in overlapping relationship in a plane perpendicular to the plane of the stringer tape 26 according to the novel concepts of this invention, and since relatively wide spacings S are consequently formed between the adjoining first loops 21, these spacings are utilized to form the second row of stitching 28 in parallel spaced relationship to the first row 27. It may be noted that each stitch of the first row 27 passes over the overlapping portions of the adjoining second loops 22, an each stitch of the second row 28 over the two shanks 24 and 25 of each first loop 21.

Positive anchorage of the continuous coupling element 20 onto the stringer tape 26 is thus established by the two rows of stitching 27 and 28. Furthermore, since the first and second loops 21 and 22 of the continuous coupling element are arranged in close contact at the three dissimilar points P1 to P3 as above stated, the positional stability of the respective undulations of the continuous coupling element is all the more reinforced to assure a high degree of coupling efficiency.

Figure 15:
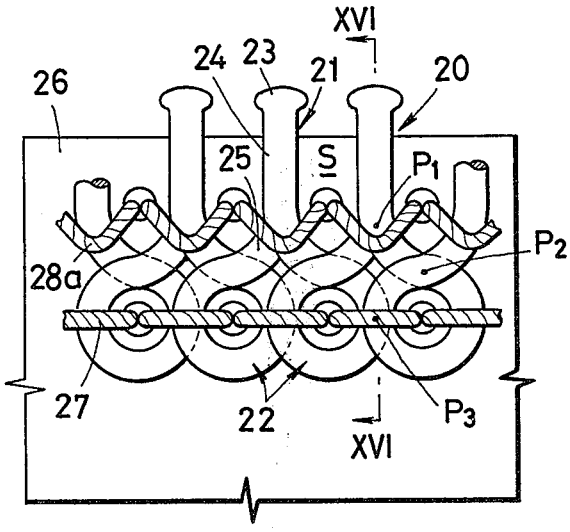
FIG. 15 is a view similar to FIG. 13 but showing an alternative mode of attachment of the continuous coupling element to a stringer tape.
Figure 16:
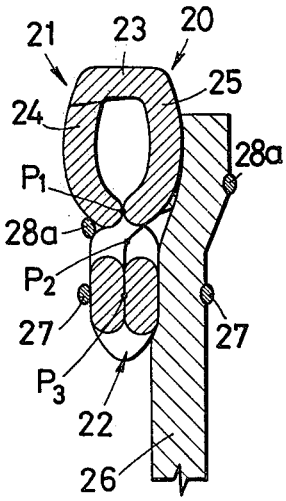
FIG. 16 is a cross sectional view taken along the plane of line XVI—XVI in FIG. 15.

FIGS. 15 and 16 illustrate an alternative mode of attachment of the continuous coupling element 20 to the stringer tape 26, in which the stitches of the second row 28*a* pass not straightly over the respective first loops 21 but around the rear ends of the first loops. The second row of stitches 28*a* is therefore arranged in a zigzag configuration when seen in a plan view as in FIG. 15.

Having thus described the several useful and novel features of the continuous coupling element according to the invention, it is believed that the many objects for which it was designed have been fully accomplished. However, while but a few of the various possible embodiments of the invention have been illustrated and described herein, certain additional modifications may well occur to those skilled in the art within the broad teaching hereof. The invention, therefore, is understood to comprehend all such modifications coming within the scope of the following claims.

What is claimed is:

1. A continuous coupling element formed of a continuous elongated filament for attachment to a stringer tape to provide a slide fastener half, comprising a plurality of first loops having a series of uniformly spaced apart coupling heads along one longitudinal side thereof for mating engagement with identical coupling heads of a complementary continuous coupling element, each of said first loops further including a pair of shanks which are interconnected by each of said coupling heads and which are compressed into contact with each other at their ends remote from the coupling head, said pair of shanks being arranged in substantially parallel spaced relationship in a plane perpendicular to the plane of the stringer tape, and a plurality of second loops formed along the other longitudinal side of said first loops and arranged in overlapping relationship in contact with each other, each of said second loops being formed by substantially annularly arranged extensions from said shanks of said first loops which extensions include crossed portions contacting each other, whereby said first and second loops are arranged in contacting relationship at three dissimilar points, corresponding first loops and second loops being integrally connected to one another with said second loops being disposed substantially parallel to the stringer tape to come into intimate contact therewith and oriented transversely to said plane of the shanks in the first loops.

2. A continuous coupling element as defined in claim 1, wherein at least said crosswise contacting portions of said extensions are integrally united together.

3. A continuous coupling element as defined in claim 1, wherein said first and second loops are cross-sectionally asymmetric so that the side of said continuous coupling element to be held in direct contact with the stringer tape is arranged in a single plane.

4. A continuous coupling element as defined in claim 1, which is adapted to be attached to the stringer tape by a first row of stitches extending over the overlapping portions of said second loops and by a second row of stitches extending over said shanks of said first loops, said first and second rows of stitches being arranged in parallel spaced relationship to each other.

5. A continuous coupling element as defined in claim 4, wherein the stitches of said second row pass around those ends of the respective first loops which are remote from said coupling heads, whereby said second row of stitches is arranged in a zigzag configuration.

* * * * *